US006550234B2

(12) United States Patent
Guillard

(10) Patent No.: US 6,550,234 B2
(45) Date of Patent: Apr. 22, 2003

(54) INTEGRATED AIR-SEPARATION/ENERGY-GENERATION PROCESS AND PLANT FOR IMPLEMENTING SUCH A PROCESS

(75) Inventor: Alain Guillard, Paris (FR)

(73) Assignee: L'Air Liquide Societe Anonyme a Directoire et Conseil de Surveillance Pour l'Etude et l'Exploitation des Procedes Georges Claude, Paris Cedex (FR)

( * ) Notice: Subject to any disclaimer, the term of this patent is extended or adjusted under 35 U.S.C. 154(b) by 0 days.

(21) Appl. No.: 10/041,628

(22) Filed: Jan. 10, 2002

(65) Prior Publication Data

US 2002/0092306 A1 Jul. 18, 2002

(30) Foreign Application Priority Data

Jan. 12, 2001 (FR) ..... 01 00403

(51) Int. Cl.[7] ..... F02C 5/00

(52) U.S. Cl. ..... 60/39.6; 60/649; 60/39.01; 60/39.182

(58) Field of Search ..... 60/649, 39.6, 39.01, 60/39.091, 39.181, 39.19

(56) References Cited

U.S. PATENT DOCUMENTS

| | | | | |
|---|---|---|---|---|
| 4,861,369 A | | 8/1989 | von Bogdandy et al. | |
| 5,081,845 A | * | 1/1992 | Allam et al. | 62/24 |
| 5,500,098 A | * | 3/1996 | Brown et al. | 203/13 |
| 5,572,861 A | | 11/1996 | Shao | |
| 5,740,673 A | | 4/1998 | Smith et al. | |
| 6,116,052 A | * | 9/2000 | Ha et al. | 62/646 |
| 6,202,442 B1 | * | 3/2001 | Brugerolle | 62/649 |

OTHER PUBLICATIONS

By W.K.F. Keller, "Der Gud–Prozess", *BWK Brennstoff Warme Kraft*, Dusseldorf, Germany, vol. 41, No. 9, Sep. 1, 1989, pp. 413–423.

* cited by examiner

*Primary Examiner*—Hoang Nguyen
(74) *Attorney, Agent, or Firm*—Young & Thompson

(57) ABSTRACT

Integrated air-separation process and plant, including at least two air separation units (1, 101), an air compressor (13), which feeds a combustion chamber and at least one of the air separation units with compressed air, and at least one dedicated air compressor (21, 121) feeding one or both of the air separation units, so that, if both air separation units receive air from the compressor (13), the proportions of air coming from the air compressor are different in the case of the two air separation units.

29 Claims, 2 Drawing Sheets

INTEGRATED AIR-SEPARATION/ENERGY-GENERATION PROCESS AND PLANT FOR IMPLEMENTING SUCH A PROCESS

BACKGROUND OF THE INVENTION

The present invention relates to an integrated air-separation/energy-generation process and to a plant for implementing such a process.

It is well known to send a nitrogen-enriched gas from an air separation unit upstream of a turbine for expanding combustion gas. The combustion chamber is fed with compressed air coming from an air compressor which may deliver all or some of the air needed for the air separation unit (ASU) as illustrated in EP-A-0 538 118. Alternatively, as in the case of GB-A-2 067 688, all the air may come from a dedicated compressor.

If it were desired to produce argon, EP-A-568 431 describes the use of an integrated system.

The difficulties in regulating this kind of system are explained in EP-A-0 622 595.

In general, for reasons of reliability, on the same site there are two gas turbines and two air separation units, which are substantially identical, producing both impure oxygen, needed for the gasification of fuels, and nitrogen. Each separation unit is fed from a gas turbine compressor and sends nitrogen only to this same gas turbine.

It is one object of the invention to remedy the defects of the known systems.

SUMMARY OF THE INVENTION

In particular, one object of the invention is to allow greater flexibility in the choice of products coming from an integrated air-separation/gas-turbine system. According to one aspect of the invention, this provides an integrated air-separation process producing an oxygen-enriched fluid and, optionally, a nitrogen-enriched fluid in a plant comprising at least two air separation units, each comprising at least two distillation columns, a first air compressor, a first combustion chamber and a first expansion turbine, in which process compressed air is delivered to the first air separation unit at least by the first air compressor which also delivers compressed air to the first combustion chamber, compressed air is delivered to the second air separation unit at least by an auxiliary compressor, the second separation unit:

i) not receiving air from a compressor which feeds a combustion chamber or ii) receiving air which it treats by means of at least one compressor which also feeds a combustion chamber, the percentage of total air, treated in the second unit, which comes from the compressor feeding a combustion chamber, being less than the percentage of air, treated in the first unit, coming from the first air compressor (or coming from the first air compressor and a second air compressor also feeding a second combustion chamber), a nitrogen-enriched gas is sent from the first air separation unit upstream of at least one expansion turbine fed with combustion gases from at least one of the combustion chambers and optionally a nitrogen-enriched gas is sent from the second air separation unit upstream of at least one expansion turbine fed with combustion gases from at least one of the combustion chambers.

Preferably, the percentage of the total air, treated in the second unit, which comes from the compressor feeding a combustion chamber represents at most 80%, or at most 50% or even at most 30% of the percentage of air, treated in the first unit, coming from the first air compressor (or coming from the first air compressor and from a second air compressor which also feeds a second combustion chamber).

In certain methods of implementing the invention, an oxygen-enriched gas is sent from the first unit and/or the second unit to a gasifier or several gasifiers. This or these gasifiers deliver fuel to the combustion chamber (combustion chambers).

According to optional aspects of the invention:

the nitrogen-enriched gas coming from the first air separation unit is sent upstream of the first expansion turbine fed with combustion gases from a combustion chamber and a nitrogen-enriched gas sent from the second air separation unit is sent upstream of at least one expansion turbine fed with combustion gases from at least one combustion chamber, optionally the first turbine;

the percentage of cryogenic liquid produced as final product by the second unit with respect to the flow of air treated by the second unit is greater than the percentage of cryogenic liquid produced as final product by the first unit with respect to the flow of air treated by the first unit, or in which the second unit produces cryogenic liquid while the first unit produces none. For example, the second unit may produce a liquid richer in oxygen and/or a liquid richer in nitrogen and/or a liquid richer in argon than air;

the second air separation unit receives at most 50%, optionally at most 30%, of the compressed air which it treats from one or more compressors feeding one or more combustion chambers with compressed air, optionally the first compressor;

the first air separation unit is fed with air from a second air compressor which also feeds a second combustion chamber, the combustion gases from the second combustion chamber being sent to a second expansion turbine;

the first separation unit produces one or more oxygen-enriched fluids, this fluid containing at most 98 mol % oxygen and/or at least 80% of these products consisting of a fluid containing at most 98 mol % oxygen, preferably at most 97 mol %;

the first separation unit produces oxygen-enriched products, at least 90% of these oxygen-enriched fluids consisting of one or more fluids containing at most 98 mol % oxygen;

the second separation unit produces one or more oxygen-enriched fluids, this fluid containing at least 98 mol % oxygen or at least 50% of these oxygen-enriched fluids consisting of one or more fluids containing at least 98 mol % oxygen;

the first separation unit produces oxygen-enriched products, at least 70% of these products consisting of a fluid containing at least 98 mol % oxygen;

the first air separation unit is also fed with compressed air by a compressor which does not feed a combustion chamber and/or which feeds only the first air separation unit;

the second air separation unit is fed with compressed air by a compressor which does not feed a combustion chamber and/or which feeds only the second air separation unit;

the second air separation unit produces an argon-enriched final product;

only the second air separation unit produces an argon-enriched final product or in which the second air separation unit produces more argon-enriched final product(s) than the first unit;

the first air separation unit comprises a blowing turbine and/or the second air separation unit comprises a Claude turbine;

a compressor feeds both air separation units and does not feed a combustion chamber;

the first unit and/or the second unit comprise/comprises a low-pressure column from which an oxygen-enriched product fluid is derived, this low-pressure column operating at at least 1.3 bara, optionally at least 3 bara;

the first and/or second unit comprises a low-pressure column and a high-pressure column, and optionally a column operating at intermediate pressure between the low and high pressures;

the air sent from the first compressor to the first and/or the second air separation unit is compressed or expanded and/or the air sent from the second compressor to the first and/or second air separation unit is compressed or expanded.

According to another aspect of the invention, this provides an integrated plant comprising a first air separation unit, a second air separation unit, a first compressor, a combustion chamber, an expansion turbine, an auxiliary compressor, means for sending air from the first compressor to the combustion chamber and to the first air separation unit, means for sending air from the auxiliary compressor to the second separation unit and no means for sending air from the first compressor or another compressor associated with a combustion chamber to the second air separation unit.

Preferably, the plant comprises means for sending a nitrogen-enriched gas from the first separation unit upstream of the expansion turbine and/or means for sending a nitrogen-enriched gas from the second separation unit upstream of the expansion turbine and/or means for sending an oxygen-enriched gas from the first unit and/or from the second unit to one or more gasifiers which delivers or deliver fuel for (at least) one (the) combustion chamber.

According to other aspects of the invention, the plant may comprise:

means for sending air from the dedicated compressor to the first unit;

the first unit does not include a means of producing liquid as final product and/or the second unit does include a means of producing liquid as final product;

the first unit does not include an argon production column and/or the second unit does include an argon production column;

the first unit includes a blowing turbine and/or the second unit includes a Claude turbine and optionally does not include a blowing turbine.

According to another aspect of the invention, this provides an integrated air separation process producing an oxygen-enriched fluid and optionally a nitrogen-enriched fluid in a plant comprising at least two air separation units, each comprising at least two distillation columns, a first air compressor, a first combustion chamber and a first expansion turbine, in which process compressed air is delivered to the first air separation unit at least by the first air compressor, which also delivers compressed air to the first combustion chamber, compressed air is delivered to the second air separation unit at least by an auxiliary compressor which does not feed a combustion chamber but which also feeds the first air separation unit.

According to another aspect of the invention, this provides an integrated plant comprising a first air separation unit, a second air separation unit, a first compressor, a combustion chamber, an expansion turbine, an auxiliary compressor, means for sending air from the first compressor to the combustion chamber and to the first air separation unit, means for sending air from the auxiliary compressor to the first air separation unit and to the second air separation unit, this auxiliary compressor not feeding a combustion chamber.

Preferably, the auxiliary compressor is not connected with a unit which consumes compressed air, apart from the first and second air separation units.

Thus, the first air separation unit receives proportionally more air from a gas turbine than the second air separation unit. This second unit may even not be integrated at all with a gas turbine or else it may produce a nitrogen-enriched stream which is sent to the gas turbine.

Thus, the first air separation unit receives more air from a gas turbine than the second air separation unit. This second unit, which may even not be integrated at all with a gas turbine.

The degree of integration determines what products may be output by each unit, in general the products purest in oxygen and/or in argon coming from the second unit, the operation of which will be more stable, thanks to the low degree of integration.

BRIEF DESCRIPTION OF THE DRAWINGS

Processes and plants according to the invention will now be described with reference to FIGS. 1 and 2, which are schematic drawings of integrated plants.

DESCRIPTION OF THE PREFERRED EMBODIMENTS

Figure 1:
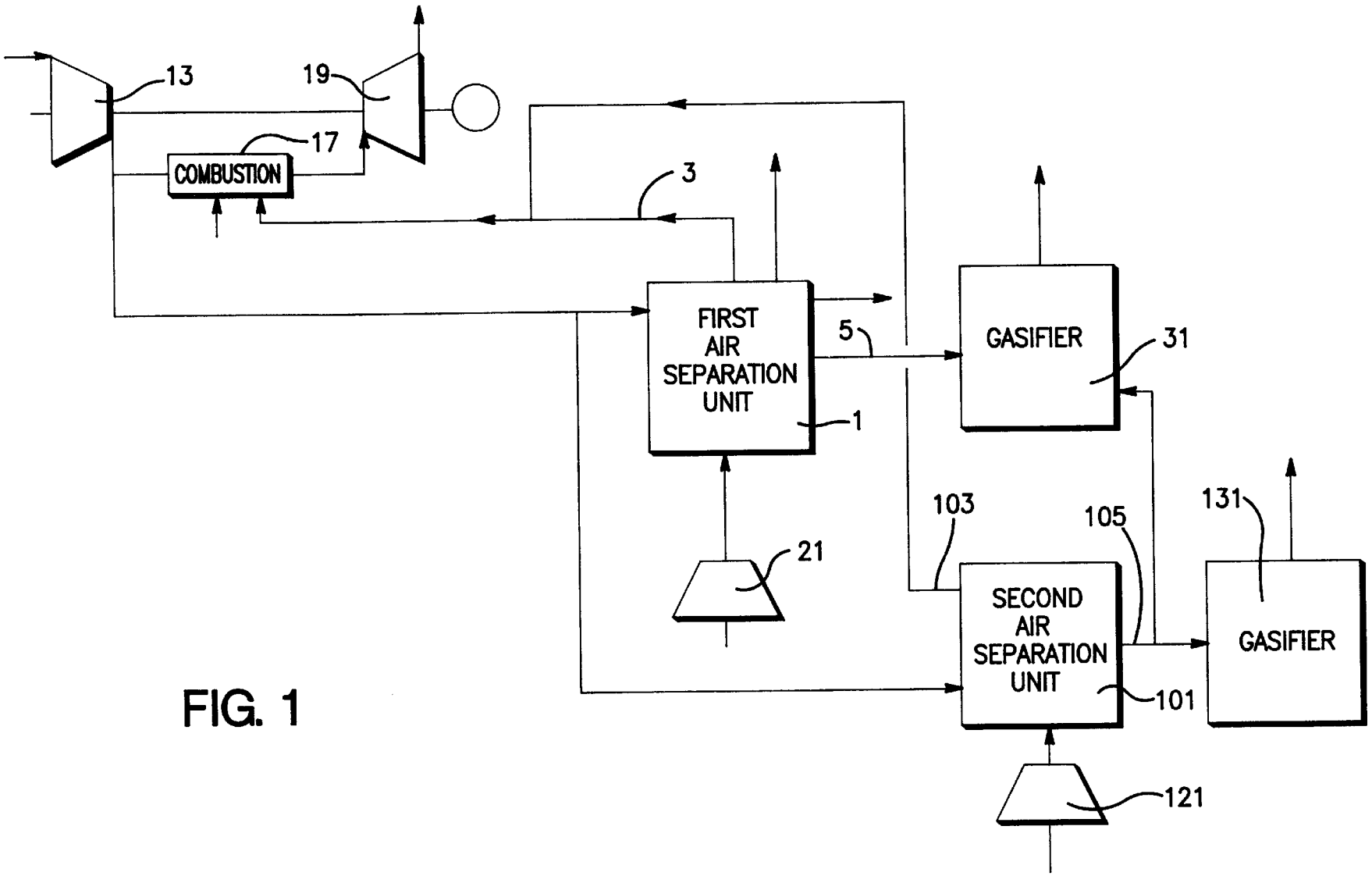

In FIG. 1, a compressor 13 is fed with air and sends a first stream of air to a combustion chamber 17 with fuel, a second stream of air to a first air separation unit 1 and, optionally, a third stream of air to a second air separation unit 101, the third stream being in general less than the second stream.

The means for cooling the air from the outlet temperature of the compressor 13 to a temperature close to ambient upstream of the air separation unit 1 and upstream of the air separation unit 101 are not illustrated.

The first air separation unit 1 is also fed with air by a compressor 21, which feeds only the latter, and the second air separation unit 101 is also fed with air by a compressor 121, which only feeds the latter. Alternatively, each of the compressors 21, 121 may feed the first and the second air separation units or only one of the compressors 21 or 121 may feed the first and second air separation units (not illustrated).

The first air separation unit, typically of the double-column or triple-column type, produces at least one nitrogen-enriched gas 3 and an oxygen-enriched high-pressure gas 5 containing at most 98 mol. % oxygen, possibly at most 95 mol. % oxygen or even at most 93 mol. % oxygen, which is sent to a gasifier 31. The nitrogen-enriched gas is sent to the combustion chamber 17 or to another point upstream of the turbine 19.

The first unit may optionally produce a small amount of liquid.

In the example, argon is not produced.

Some of the air sent to the air separation unit 1 may be sent through a blowing turbine (which supplies the low-pressure column of the double or triple column).

The second air separation unit produces oxygen 105 containing at least 98 mol. % oxygen, gaseous argon and/or liquid and, optionally, liquids rich in nitrogen or oxygen, together with a stream of impure nitrogen 103 which may optionally be sent to the combustion chamber 17.

Optionally, some of the oxygen 105 may be sent to the gasifier 31.

The second unit 101 is preferably of the type under pressure, therefore with a low-pressure column, from which the oxygen-enriched fluid is withdrawn, operating above 1.5 bara, preferably above 3 bara.

The second unit may include a column for purifying an argon-enriched stream.

Preferably, some of the air sent to the second unit 101 is expanded in a Claude turbine before being sent to the air distillation column operating at the higher pressure.

Preferably, the ratio of the flow of air sent from the compressor 121 to the unit 101 to the flow of air (if there is one) sent from the compressor 13 to this unit 101 is greater than the ratio of the flow of air sent from the compressor 21 to the unit 1 to the flow of air sent from the compressor 13 to this unit 1.

Optionally, the two compressors 21, 121 may be replaced with a single compressor feeding the units 1, 101.

Figure 2:
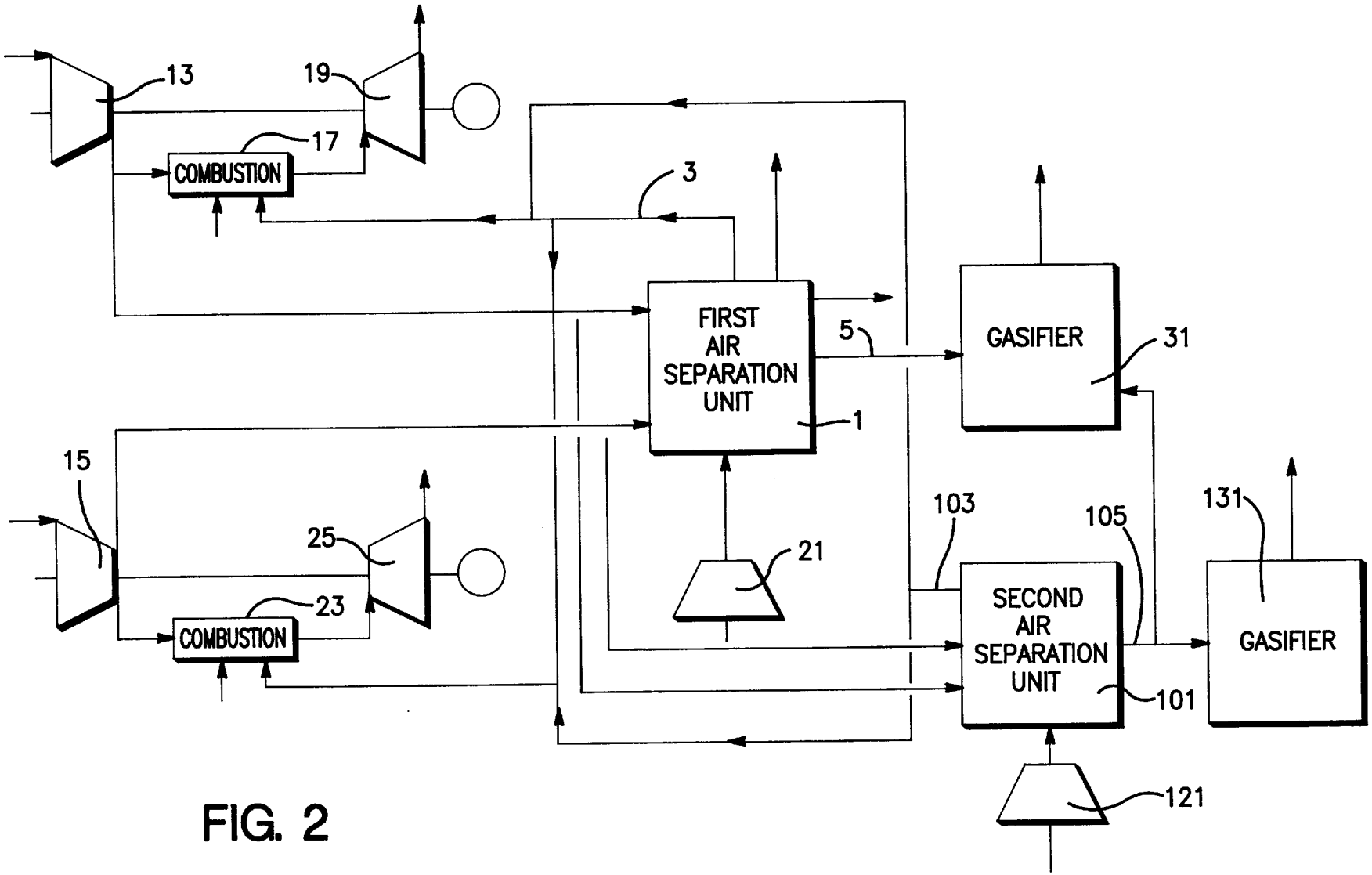

In FIG. 2, a first air compressor 13 delivers air to the first air separation unit 1 and to a first combustion chamber 17, the combustion gases of which feed a first expansion turbine 19 which allows electricity to be generated.

A second air compressor 15 delivers air to the air separation unit 1 and to a second combustion chamber 23, the combustion gases of which feed a second expansion turbine 25 which allows electricity to be generated. A third air compressor 21 delivers air exclusively to the air separation unit.

The means for cooling the air from the outlet temperature of the compressors 13, 15 to a temperature close to ambient upstream of the first air separation unit 1 and upstream of the second air separation unit 101 have not been illustrated.

The waste gas 3 from the separation unit 1 may be sent upstream of the first and/or the second turbine, for example to the first and/or to the second combustion chamber and/or to the inlet of the first and/or the second turbine.

The oxygen-enriched gas 5 under pressure is preferably sent to one or more gasifiers 31, 131, where it is used to produce fuel for at least one of the combustion chambers 17, 23.

The compressors 13, 15, 21 may deliver air at different pressures, for example pressures which differ by at least 0.5 bar from one another. The streams at the highest pressures may be expanded to the lowest pressure so as to purify all the air streams together.

Otherwise, the streams may be sent to columns of the ASU operating at different pressures with adapted purification.

In the plant in FIG. 2, there are two air separation units 1, 101, each having at least two distillation columns and each having, optionally, its own cold box.

The unit 1 produces the same products as those described above: the unit 101 produces at least waste nitrogen 103 and oxygen-enriched gas, optionally at several pressures, or at least at high pressure.

The waste nitrogen 103 may be sent to the first and/or the second combustion chamber or, alternatively, may be discharged into the atmosphere, used for purification regeneration of first and/or second units 1, 101, or used for other purposes.

The oxygen 105 may be sent to another gasifier 131, the gasifier 31 or another point of use, particularly if its purity is different from that of the oxygen 5. As described above, the unit 101 may deliver mainly or only pure oxygen containing more than 98 mol % oxygen, whereas the first unit may produce only or mainly impure oxygen containing less than 95 mol % oxygen.

The unit 101 is fed with air from a dedicated compressor 121 and, optionally, very partially from the first compressor 13 and/or the second compressor 15 and/or the dedicated compressor 21 and/or a dedicated compressor which sends air to both air separation units.

What is claimed is:

1. An integrated air-separation process in a plant that has at least two air separation units that each have at least two distillation columns, at least one air compressor, at least one combustion chamber, at least one auxiliary air compressor that does not feed any combustion chamber, and at least one expansion turbine, the process comprising the steps of:

delivering compressed air to a first of the at least two air separation units using the at least one air compressor;

delivering compressed air to the at least one combustion chamber using the at least one air compressor; and delivering compressed air to a second of the at least two air separation units using the at least one auxiliary air compressor, wherein compressed air is not delivered to the second air separation unit from any air compressor that feeds any combustion chamber.

2. The process of claim 1, wherein the process produces a nitrogen-enriched fluid, and further comprising the step of feeding the nitrogen-enriched fluid from the first air separation unit to the at least one combustion chamber.

3. The process of claim 1, further comprising the step of feeding a nitrogen fluid from the second air separation unit to the at least one combustion chamber.

4. The process of claim 1, further comprising the steps of, also delivering compressed air to the first air separation unit using a second of the at least one air compressor, delivering compressed air to a second of the at least one combustion chamber using the second air compressor, and feeding a nitrogen-enriched fluid from the first air separation unit to the second combustion chamber.

5. The process of claim 4, further comprising the step of feeding a nitrogen-enriched fluid from the second air separation unit to the first and second combustion chambers.

6. The process of claim 4, further comprising the step of feeding a combustion gas from the second combustion chamber to a second of the at least one expansion turbines.

7. The process of claim 1, wherein the first air separation unit produces the oxygen-enriched fluid and at least 80% of the oxygen-enriched fluid contains at most 98 mol % oxygen.

8. The process of claim 1, wherein the second air separation unit produces the oxygen-enriched fluid and at least 50% of the oxygen-enriched fluid contains at least 98 mol % oxygen.

9. The process of claim 1, further comprising the step of delivering to the first air separation unit compressed air from a second of the at least one auxiliary compressor.

10. The process of claim 1, further comprising the step of producing an argon-enriched final product in the second air separation unit.

11. The process of claim 1, wherein each of the first and second air separation units includes a low-pressure column, a high-pressure column, and a column operating at intermediate pressure between the low and high pressures.

12. An integrated air-separation process in a plant that has at least two air separation units that each have at least two distillation columns, at least one air compressor, at least one combustion chamber, at least one auxiliary air compressor that does not feed any combustion chamber, and at least one expansion turbine, the process comprising the steps of:

delivering compressed air to a first of the at least two air separation units using the at least one air compressor;

delivering compressed air to the at least one combustion chamber using the at least one air compressor; and delivering compressed air to the first air separation unit and to a second of the at least two air separation units using the at least one auxiliary air compressor, wherein compressed air is not delivered to the second air separation unit from the at least one air compressor that feeds the at least one combustion chamber.

13. An integrated air-separation process producing an oxygen-enriched fluid and a nitrogen-enriched fluid in a plant that has at least two air separation units that each have at least two distillation columns, at least one air compressor, at least one combustion chamber, at least on auxiliary air compressor that does not feed any combustion chamber, and at least one expansion turbine, the process comprising the steps of:

delivering compressed air to a first and a second of the at least two air separation units using the at least one air compressor;

delivering compressed air to the at least one combustion chamber using the at least one air compressor;

delivering compressed air to the first and second air separation units using the at least one auxiliary air compressor, wherein compressed air from the at least one air compressor provides a greater percentage of a total amount of compressed air received by the first air separation unit from the at least one air compressor and the auxiliary air compressor than a corresponding percentage received by the second air separation unit;

feeding combustion gases from the at least one combustion chamber to the at least one expansion turbine; and feeding the nitrogen-enriched fluid from the first air separation unit to the at least one combustion chamber.

14. The process of claim 13, further comprising the step of feeding a nitrogen fluid from the second air separation unit to the at least one combustion chamber.

15. The process of claim 13, further comprising the steps of, also delivering compressed air to the first air separation unit using a second of the at least one air compressor, delivering compressed air to a second of the at least one combustion chamber using the second air compressor, and feeding the nitrogen-enriched fluid from the first air separation unit to the second combustion chamber.

16. The process of claim 15, further comprising the step of feeding a nitrogen fluid from the second air separation unit to the first and second combustion chambers.

17. The process of claim 15, further comprising the step of feeding a combustion gas from the second combustion chamber to a second of the at least one expansion turbines.

18. The process of claim 13, wherein the percentage of the total amount of compressed air received by the second air separation unit from the at least one air compressor is no more than 50%.

19. The process of claim 13, wherein the first separation unit produces the oxygen-enriched fluid and at least 80% of the oxygen-enriched fluid contains at most 98 mol % oxygen.

20. The process of claim 13, wherein the second separation unit produces the oxygen-enriched fluid and at least 50% of the oxygen-enriched fluid contains at least 98 mol % oxygen.

21. The process of claim 13, further comprising the step of producing an argon-enriched final product in the second air separation unit.

22. The process of claim 13, wherein each of the first and second air separation units includes a low-pressure column, a high-pressure column, and a column operating at intermediate pressure between the low and high pressures.

23. An integrated plant comprising:

a first air separation unit that does not produce a liquid as a final product;

a second air separation unit that includes means for producing a liquid as a final product;

a first compressor, a combustion chamber fed air from said first compressor, and an expansion turbine fed combustion gas from said combustion chamber, said first compressor also feeding air to said first air separation unit; and a first auxiliary compressor that feeds air to said second air separation unit, said second air separation unit not receiving air from any compressor that feeds air to any combustion chamber.

24. The plant of claim 23, further comprising a second auxiliary compressor that feeds air to said first air separation unit.

25. The plant of claim 23, wherein said first auxiliary compressor also feeds air to said first air separation unit.

26. The plant of claim 23, wherein said first air separation unit does not include an argon production column and said second air separation unit does include an argon production column.

27. The plant of claim 23, wherein said first air separation unit includes a blowing turbine and said second air separation unit includes a Claude turbine.

28. An integrated plant comprising:

a first air separation unit;

a second air separation unit;

a combustion chamber;

a first compressor that feeds air to said combustion chamber and said first air separation unit;

an expansion turbine; and an auxiliary compressor that feeds air to said first air separation unit and to said second air separation unit and that does not feed air to said combustion chamber.

29. The plant of claim 28, wherein said auxiliary compressor is not connected to anything that consumes compressed air, other than said first and second air separation units.

* * * * *